US008484931B2

(12) United States Patent
Gleeson et al.

(10) Patent No.: US 8,484,931 B2
(45) Date of Patent: Jul. 16, 2013

(54) EXTERNAL AND INTERNAL WALL CLADDING SYSTEM

(75) Inventors: James Gleeson, New South Wales (AU); Darren Southwell, New South Wales (AU); Lindsay Hill, New South Wales (AU)

(73) Assignee: James Hardie Technology Limited, Dublin (IE)

( * ) Notice: Subject to any disclaimer, the term of this patent is extended or adjusted under 35 U.S.C. 154(b) by 516 days.

(21) Appl. No.: 12/044,682

(22) Filed: Mar. 7, 2008

(65) Prior Publication Data

US 2008/0216430 A1 Sep. 11, 2008

(51) Int. Cl.
*E04B 1/00* (2006.01)
*E04B 2/30* (2006.01)

(52) U.S. Cl.
USPC ..... 52/747.1; 52/489.1; 52/523; 52/582.1

(58) Field of Classification Search
USPC ..... 52/593.1, 489.1, 489.2, 519, 523, 52/524, 539, 588.1, 483.1, 747.1, 747.11
See application file for complete search history.

(56) References Cited

U.S. PATENT DOCUMENTS

| | | | | |
|---|---|---|---|---|
| 331,469 | A | 12/1885 | Baker | |
| 1,630,801 | A | 5/1927 | Parsons | |
| 1,440,358 | A | 12/1927 | Whetstone | |
| 1,698,557 | A | 1/1929 | O'Brien | |
| 3,187,389 | A * | 6/1965 | Anderson | 52/489.1 |
| 3,219,401 | A | 11/1965 | Mapson | |
| 3,323,819 | A | 6/1967 | Barker | |
| 3,481,093 | A | 12/1969 | Davidson | |
| D216,836 | S | 3/1970 | Faulkner et al. | |
| D234,437 | S | 3/1975 | Craik | |
| 3,869,295 | A | 3/1975 | Bowles et al. | |
| D237,269 | S | 10/1975 | Edwards | |
| D237,271 | S | 10/1975 | Edwards | |
| 3,986,312 | A | 10/1976 | Calhoun et al. | |
| 4,052,829 | A | 10/1977 | Chapman | |
| 4,076,884 | A | 2/1978 | Riley et al. | |
| 4,366,657 | A | 1/1983 | Hopman | |
| 4,373,957 | A | 2/1983 | Pedersen | |
| D275,705 | S | 9/1984 | Gabriel | |
| 4,680,911 | A | 7/1987 | Davis et al. | 52/521 |

(Continued)

FOREIGN PATENT DOCUMENTS

| | | | |
|---|---|---|---|
| AU | 90831 | S | 8/1985 |
| AU | 95374 | S | 2/1987 |

(Continued)

OTHER PUBLICATIONS

Decision of Opposition in relation to Taiwanese Patent Application No. 85114421, issued Aug. 3, 1998.

(Continued)

*Primary Examiner* — William Gilbert
(74) *Attorney, Agent, or Firm* — Knobbe Martens Olson & Bear, LLP

(57) ABSTRACT

A wall cladding and wall cladding system each comprising a plurality of panels, wherein opposing ends of each panel are substantially aligned with corresponding opposing ends of adjacent panels to form respective edges of an array of panels. Each panel includes at least one first recess in its first major face adjacent a first major edge configured in use to resemble a recessed mortar joint.

44 Claims, 8 Drawing Sheets

U.S. PATENT DOCUMENTS

| | | | | |
|---|---|---|---|---|
| 4,895,598 | A | 1/1990 | Hedberg et al. | |
| 4,963,430 | A | 10/1990 | Kish et al. | |
| 5,117,600 | A | 6/1992 | Yerushalmi et al. | |
| 5,242,736 | A | 9/1993 | Van Erden et al. | |
| 5,397,631 | A | 3/1995 | Green et al. | |
| 5,473,847 | A | 12/1995 | Crookston | |
| 5,622,556 | A | 4/1997 | Shulman | |
| 5,724,783 | A | 3/1998 | Mandish | |
| 5,732,520 | A | 3/1998 | Maietta | |
| 5,736,594 | A | 4/1998 | Boles et al. | |
| 5,747,142 | A | 5/1998 | Bleasdale | |
| 5,960,598 | A | 10/1999 | Tamlyn | |
| 5,974,748 | A | 11/1999 | Sciuga et al. | |
| 6,018,924 | A | 2/2000 | Tamlyn | |
| 6,030,447 | A | 2/2000 | Naji et al. | |
| 6,279,284 | B1 | 8/2001 | Moras | |
| D448,488 | S | 9/2001 | Chaffiotte et al. | |
| 6,298,620 | B1 | 10/2001 | Hatzinikolas | |
| 6,341,458 | B1 | 1/2002 | Burt | |
| 6,355,333 | B1 | 3/2002 | Waggoner et al. | |
| D456,911 | S | 5/2002 | Janesky | |
| 6,449,915 | B1 | 9/2002 | Park | |
| 6,460,311 | B1 * | 10/2002 | Ito | 52/489.1 |
| 6,510,667 | B1 | 1/2003 | Cottier et al. | |
| 6,516,580 | B1 | 2/2003 | Maietta | |
| 6,672,016 | B2 | 1/2004 | Janesky | |
| 6,695,535 | B1 | 2/2004 | Lazes | |
| 6,701,685 | B2 | 3/2004 | Rippey | |
| D491,677 | S | 6/2004 | Barnett | |
| 6,758,017 | B2 | 7/2004 | Young | |
| 6,802,668 | B2 | 10/2004 | Parker | |
| D498,856 | S | 11/2004 | Froech | |
| 6,990,775 | B2 | 1/2006 | Koester | |
| D574,520 | S | 8/2008 | Taylor et al. | |
| D588,280 | S | 3/2009 | Gleeson et al. | |
| D588,284 | S | 3/2009 | Gleeson et al. | |
| D589,171 | S | 3/2009 | Gleeson et al. | |
| D601,720 | S | 10/2009 | Gleeson | |
| D603,533 | S | 11/2009 | Gleeson | |
| D606,671 | S | 12/2009 | Southwell | |
| D606,672 | S | 12/2009 | Southwell | |
| D607,584 | S | 1/2010 | Ito | |
| D608,020 | S | 1/2010 | Gleeson | |
| D609,824 | S | 2/2010 | Gleeson | |
| 2002/0035809 | A1 | 3/2002 | Smythe | |
| 2002/0073638 | A1 | 6/2002 | Kunz et al. | |
| 2003/0126810 | A1 | 7/2003 | Brunson et al. | |
| 2004/0020143 | A1 | 2/2004 | Webb | |
| 2004/0118076 | A1 | 6/2004 | Bezubic | |
| 2006/0005489 | A1 | 1/2006 | Smithe | |
| 2006/0005509 | A1 | 1/2006 | Yohnke et al. | |
| 2006/0010800 | A1 | 1/2006 | Bezubic | |
| 2006/0080942 | A1 | 4/2006 | O'Neill | |
| 2007/0130849 | A1 | 6/2007 | Langer et al. | |
| 2007/0266666 | A1 * | 11/2007 | Dammers | 52/536 |
| 2008/0216430 | A1 | 9/2008 | Gleeson et al. | |
| 2009/0019814 | A1 | 1/2009 | Gleeson | |
| 2009/0064599 | A1 | 3/2009 | Bennett | |
| 2010/0101159 | A1 | 4/2010 | Gleeson et al. | |

FOREIGN PATENT DOCUMENTS

| | | | |
|---|---|---|---|
| AU | 99315 | S | 1/1988 |
| AU | 105706 | S | 10/1989 |
| AU | 109294 | S | 10/1990 |
| AU | 112156 | S | 9/1991 |
| AU | 112157 | S | 9/1991 |
| AU | 122184 | S | 12/1994 |
| AU | 124159 | S | 7/1995 |
| AU | 128989 | S | 1/1997 |
| AU | 745114 | | 12/1998 |
| AU | 136553 | S | 3/1999 |
| AU | 143709 | S | 5/2001 |
| AU | 783430 | | 6/2001 |
| AU | 735352 | | 7/2001 |
| AU | 2001287356 | | 4/2002 |
| AU | 148950 | S | 8/2002 |
| AU | 2003204739 | B2 | 7/2003 |
| AU | 2003257906 | A1 | 7/2004 |
| AU | 310645 | S | 10/2006 |
| CA | 974726 | | 9/1975 |
| CA | 2244625 | | 2/2000 |
| DE | 2440497 | | 3/1976 |
| EP | 0024360 | | 3/1981 |
| EP | 0074338 | | 3/1983 |
| EP | 0305209 | | 3/1989 |
| EP | 0373017 | | 6/1990 |
| EP | 0430667 | | 6/1991 |
| EP | 1243714 | | 9/2002 |
| GB | 558239 | | 12/1943 |
| GB | 564447 | | 9/1944 |
| GB | 1174902 | | 12/1969 |
| GB | 1590875 | | 6/1981 |
| GB | 1086311 | | 3/2001 |
| GB | 2378192 | | 2/2003 |
| JP | 06278116 | | 10/1994 |
| JP | 7279275 | | 10/1995 |
| JP | 08004248 | | 1/1996 |
| JP | 08068184 | | 3/1996 |
| JP | 8-109686 | | 4/1996 |
| JP | 8-267624 | | 10/1996 |
| JP | 10280639 | | 12/1998 |
| JP | 11256683 | | 9/1999 |
| JP | 2000-1944 | | 1/2000 |
| JP | 2000-17751 | | 1/2000 |
| JP | 2000064554 | A2 | 2/2000 |
| JP | 2000336814 | | 12/2000 |
| JP | 2001-227100 | | 8/2001 |
| JP | 2002161623 | A2 | 6/2002 |
| JP | 2003-239408 | | 8/2003 |
| JP | 3733370 | | 1/2006 |
| JP | 2007-16428 | | 1/2007 |
| NZ | 334899 | | 4/2000 |
| NZ | 335529 | | 12/2000 |
| NZ | 502017 | | 1/2001 |
| NZ | 525507 | | 9/2004 |
| NZ | 536129 | | 2/2006 |
| TW | 278537 | | 6/1996 |
| TW | 282800 | | 8/1996 |
| TW | 278536 | | 4/2007 |
| WO | WO-8102758 | | 10/1981 |
| WO | WO-9324711 | | 12/1993 |
| WO | WO-9708111 | | 3/1997 |
| WO | WO-9964692 | | 12/1999 |
| WO | WO-02096824 | | 12/2002 |
| WO | WO 03/035998 | | 5/2003 |
| WO | WO 03/089726 | | 10/2003 |
| WO | WO 2004/092494 | | 10/2004 |
| WO | WO 2004087412 | | 10/2004 |
| WO | WO-2005003478 | | 1/2005 |
| WO | WO-2005035900 | | 4/2005 |
| WO | WO-2005068741 | | 7/2005 |
| WO | WO-2005078210 | | 8/2005 |
| WO | WO2006/032378 | * | 3/2006 |
| WO | WO 2008/113136 | | 9/2008 |

OTHER PUBLICATIONS

Decision of Appeal in relation to Taiwanese Patent Application No. 85114421, issued Feb. 24, 1999.

U.S. Appl. No. 29/324,083, filed Sep. 5, 2008 entitled "Building Element", First Named Inventor: Darren Southwell.

U.S. Appl. No. 29/324,087, filed Sep. 5, 2008 entitled "Building Element", First Named Inventor: Darren Southwell.

Simplicity Tool Corporation, "Off Stud Joiners," May 12, 2009, 1 p.

Simplicity Tool Corporation, "Installation Instruction for Off Stud Joiners,", May 12, 2009, 1 p.

CertainTeed WeatherBoards™ Fiber Cement Siding, "Lap Siding Installation Guide," Oct. 2008, 8 pp.

BGC Fibre Cement, "Duraplank™ Technical Information for Duraplank™ Woodgrain and Smooth for External Cladding," Apr. 2007, 12 pp.

James Hardie®, "External Cladding Technical Specification," Sep. 2005, 32 pp.

James Hardie®, "Scyon™ Stria™ Cladding Installation Instructions," Jun. 2008, 6 pp.

International Search Report for International PCT Application No. PCT/AU2007/000096 dated Mar. 29, 2007.
New Zealand Building Code Acceptable Solution E2/AS1, External Moisture, Department of Building and Housing, Jul. 1, 2005, p. 55-90.
ETERNIT Building Materials, Cladding, "Glasal Fibre Cement Cladding Panels," May 2003.
ETERNIT Building Materials, Cladding, "Omega and Zeds," May 2003.
Scyon™ Matrix™ website printed Sep. 13, 2006, at http://www.jameshardie.com.au/Products/Scyon/Cladding/Matrix/default.htm.
Scyon™ Axon™ website printed Sep. 13, 2006. at http://www.jameshardie.com.au/Products/Scyon/Cladding/Axon/.
Scyon™ Linea™ website printed Sep. 13, 2006, at http://www.jameshardie.com.au/Products/Scyon/Cladding/Linea/default.htm.
Southwell, D., Design U.S. Appl. No. 29/351,069 entitled "Building Element," Nov. 30, 2009.
Southwell, D., Design U.S. Appl. No. 29/351,068 entitled "Building Element," Nov. 30, 2009.

* cited by examiner

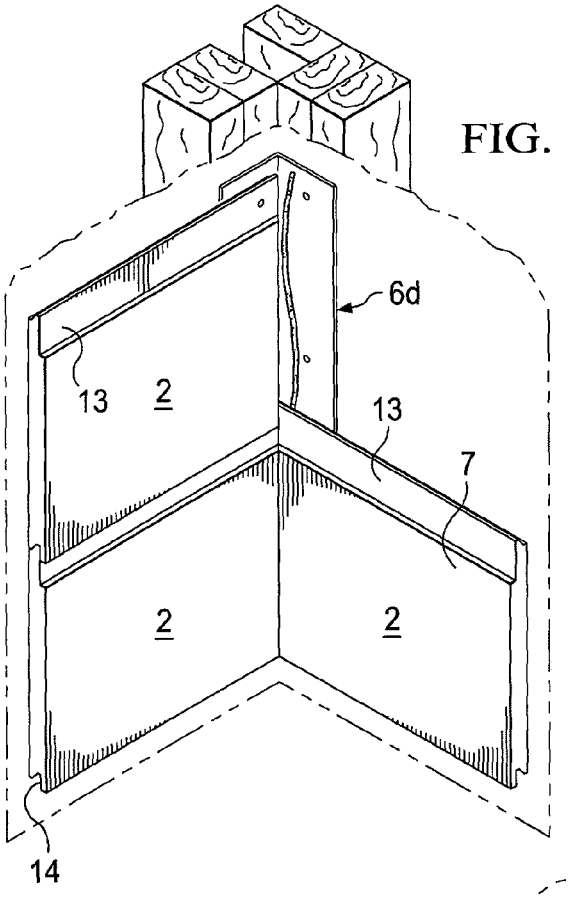
FIG. 16
FIG. 17
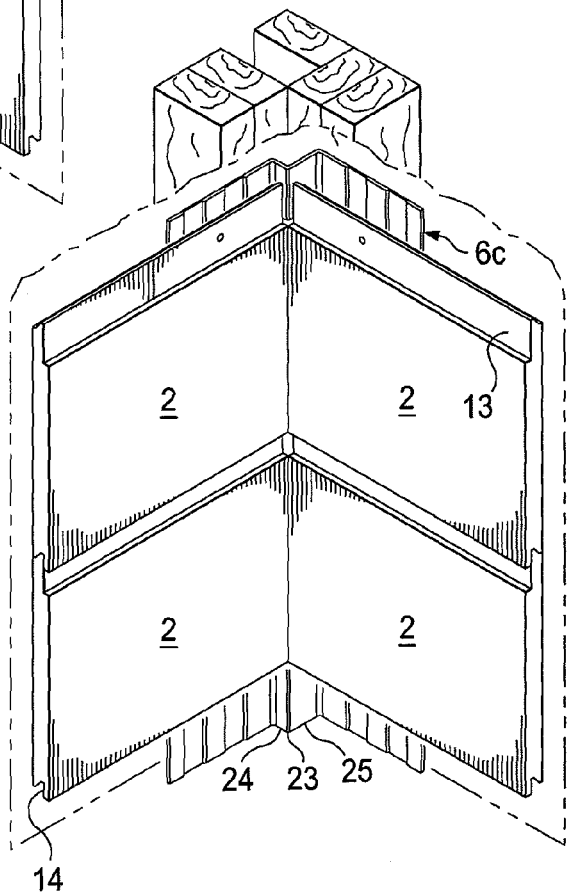

EXTERNAL AND INTERNAL WALL CLADDING SYSTEM

CROSS-REFERENCES TO RELATED APPLICATIONS

This application claims the benefit for priority from Australian Provisional Application No. 2007901214 filed Mar. 8, 2007.

BACKGROUND

The invention described relates generally to the field of building products and, more particularly, to building products having recessed joints.

Cement render applied over a thin panelised substrate may be used to provide one form of a masonry replica cladding system. Such systems usually require some form of mesh, fixed to a panel underlay, as a support and restraint for the render, use to provide the masonry appearance. These systems are relatively costly, time-consuming and, thus, inefficiently designed. For example, to install, such systems require specific skills and qualified persons to achieve a satisfactory appearance of the finished wall. Furthermore, the thickness of render applied in these systems does not generally allow for aesthetic finishes such as recessed joint lines without exposing the supporting mesh structure. Other systems that use thin ceramic tiles fixed to or hung on steel framing offer additional disadvantages. For example, tiles, which are inflexible, are unable to compensate for uneven framing. In addition, each tile system requires its own specific and special purpose framing to properly operate. An additional disadvantage includes the fact that working with individual tiles requires additional and labor-intensive handling operations. Other systems for large panel type cladding (e.g., similar to that used in commercial buildings) use plain panels mounted on special batten systems and, as such, remain unsuitable for replicating masonry and offer little aesthetic appeal.

Any discussion of the prior art throughout the specification and in the background should in no way be considered an admission that such prior art is widely known or forms part of common general knowledge in the field.

SUMMARY

The invention described addresses one or more problems as described above and associated with current cladding system.

In one or more forms is provided a wall cladding and wall cladding system, each comprising a plurality of panels, wherein opposing ends of each panel are substantially aligned with corresponding opposing ends of adjacent panels to form respective edges of an array of panels. Each panel includes at least one first recess in its first major face adjacent a first major edge configured in use to resemble a recessed mortar joint. Each panel typically has having first and second major opposing faces, first and second major opposing edges, and a pair of opposing ends. Each panel further has a first recess in its first major face adjacent the first major edge configured in use to resemble a recessed mortar joint wherein, when used to form at least a portion of a wall cladding, the first major edge of a first panel is positioned adjacent the second major edge of an adjacent second panel, and the opposing ends of each panel are substantially aligned with the corresponding opposing ends of adjacent panels to form respective side edges of an array of panels.

A wall cladding system as described herein may further include a sub-structure. Each panel may, in desired embodiments, be secured to the wall sub-structure.

A wall cladding system as described herein may further include a joining element. A joining element is generally positioned in contact with two adjacent arrays of panels. Contact between a joining element and at least one side edge of an array may resemble a joint.

BRIEF DESCRIPTION OF THE DRAWINGS

For more complete understanding of the features and advantages of the present invention, reference is now made to the detailed description of the invention along with the accompanying figures wherein:

FIG. 16 is a partial view of a cladding system on an internal corner of a wall structure having a mitered corner and showing a portion of an external corner trim element; and FIG. 17 is a partial view of a cladding system on an internal corner of a wall structure and showing a portion of an internal corner trim element similar to that disclosed in FIG. 12.

DETAILED DESCRIPTION

Figure 1:
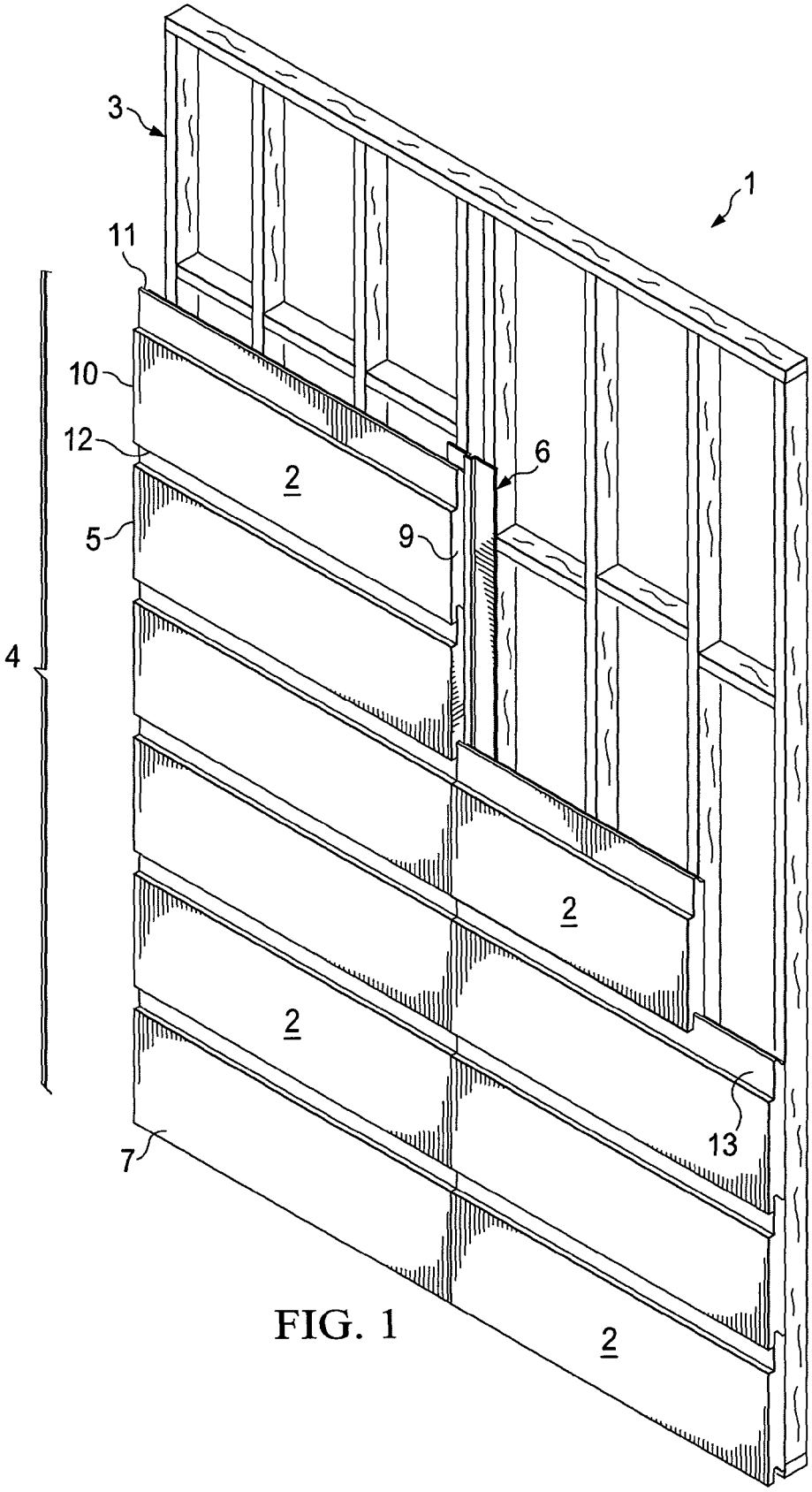
FIG. 1 is a schematic perspective view of a representative wall cladding structure formed using a cladding system as described herein.

Although making and using various embodiments are discussed in detail below, it should be appreciated that the invention described provides many inventive concepts that may be embodied in a wide variety of contexts. The embodiments discussed herein are merely illustrative of ways to make and use the described invention and do not limit the scope of the invention.

In the description which follows like parts may be marked throughout the specification and drawing with the same reference numerals, respectively. The drawing figures are not necessarily to scale and certain features may be shown exaggerated in scale or in somewhat generalized or schematic form in the interest of clarity and conciseness.

Referring to FIG. 1, there is shown a perspective view of a wall structure using a representative cladding system 1 as described herein. The cladding system comprises a plurality of panels 2, each secured to an underlying wall structure 3 so as to form an array 4. Panels may be elongate and rectangular in shape; however, such a configuration is merely representative and non-limiting. Each array is often substantially rectangular; however, alternative configurations are acceptable and may be formed. Each array has substantially vertical side edges 5. Where one array horizontally abuts another array, an optional joining strip 6 is provided, which is generally elongate (e.g., along the length of the array) and generally positioned vertically when arrays are so aligned. Further features of various forms of panel 2 and joining strip 6 are discussed below.

Figure 2:
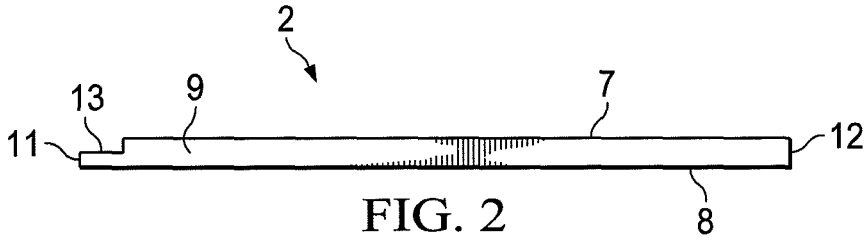
FIG. 2 is an end view of a representative panel as described herein.

Turning to FIG. 2, there is shown a representative panel 2. Panel 2 has a first outer major face 7 and an opposing second inner major face 8. The panels are generally thin. The thickness may be less than 1 cm. In some forms, the thickness is less than 20 mm. In additional embodiments, the thickness is between about 14 and 16 mm. Preferably, a panel terminates at opposing end 9 and end 10 (not shown). Each panel is also defined by a respective first and second major opposing edges 11 and 12. A first recess 13 is provided in the first major face 7 of each panel adjacent the first major edge and is configured such that in use it resembles a recessed mortar joint. Recess 13 may be elongate in shape as shown in FIG. 2 or may form an alternative and suitable configuration.

One example of a panel dimension is that having a thickness of 14 mm and a width of recess 13 of around 15 mm. A suitable length is often about 4.2 m lengths; however, it will be appreciated that this may vary, as may other dimensional parameters, to suit particular framing layouts, stud spacing arrangements and other design criteria, as desired.

In use, installation may include a first major edge of a first panel being positioned in an abutting relationship with a second major edge of an adjacent panel such that the abutment forms what resembles a recess mortar joint by taking advantage of the first recess 13. Some form of sealing strip may also be applied along the butt joint, as desired.

Figure 3:
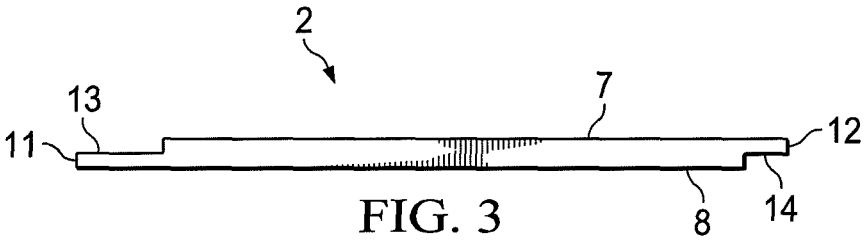
FIG. 3 is an end view of another representative panel as described herein.

Another panel embodiment is described with reference to FIG. 3 in which like references are used to denote corresponding features. Dimensions of a panel of FIG. 3 may be similar to that of FIG. 2. A difference between a panel of FIG. 2 and that of FIG. 3 resides in the edge of the panels. In this regard, first recess 13 formed in first face 7 of FIG. 3 is sized to have a width in excess of the width of the recessed mortar joint that in use is to be mimicked. In one example, first recess 13 of FIG. 3 has a width of about 35 mm. In an embodiment, such as that disclosed with FIG. 3, the depth of recess 13 is approximately 50% of the panel thickness. Other depths may be applied as desired.

Still referring to FIG. 3, a second recess 14 is typically provided along the second major edge in the second major face. The configuration is such that when a plurality of panels are used to form an array 4 (as depicted in FIG. 1) for a wall cladding, the second major edge 12 partially overlaps the recessed first major edge 11 of an adjacent panel. The extended width of the first recess 13 may be small enough just to provide a useful degree of overlap of the second edge 12 of the adjacent panel, or may be wider so as to allow either blind nailing of the panel adjacent the first edge and/or simultaneous securing of that edge with an overlying second edge of a second panel by through-fixing at the overlap. A representative example includes having a width of a second recess 14 at about 20 mm. With this dimension, when adjacent planks are aligned, approximately 15 mm of recess 13 is exposed to resemble a recessed mortar joint.

Figure 4:
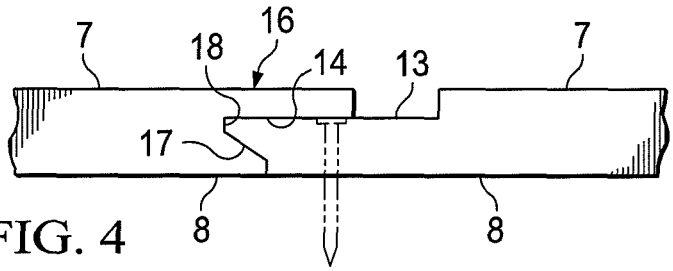
FIG. 4 is an enlarged end view of two inter-engaging panels configured to allow blind nailing and for retaining a next adjacent panel.

Referring to FIG. 4, there is shown a panel to panel abutment. Once again, like reference numerals are used to denote corresponding features. A panel to panel location and/or locking arrangement is shown with reference to 16. The arrangement further includes a retaining formation 17 formed on the first major edge which is adapted to inter-engage a second retaining formation 18 formed on an innermost edge of the second recess 14 formed along the second major edge. In use, this arrangement serves to locate and retain each panel in an engaging alignment with an adjacent panel.

A representative dimension for an arrangement as depicted in FIG. 4 includes having a first recess 13 of about 40 mm wide and an upper limit in width of a second recess at about 25 mm. With such an arrangement, the depth of both recesses is typically approximately 50% of the panel thickness. It will be appreciated by those skilled in the art, however, that the depth and width of the recesses may be varied as desired and without undue practice to provide a wide range of desired aesthetic appearances and effects.

Figure 5:
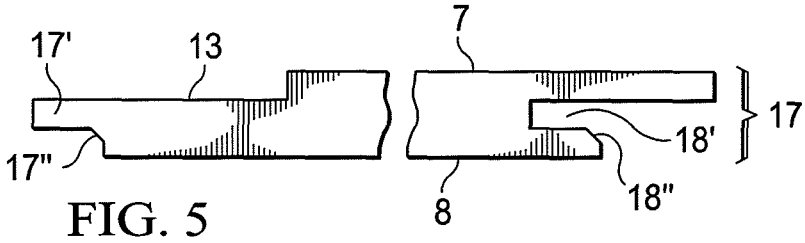
FIG. 5 is an enlarged view of another representative inter-engaging panel.

FIG. 5 shows still another panel arrangement. The feature depicted in FIG. 5 is optional yet, when in use, allows for alignment adjustment during installation. The edge arrangement in FIG. 5 depicts a wedge formation 17 (on one edge) that includes a wedge groove 18'. In addition there is rather parallel-looking tongue arrangement 17' (on the alternate edge) that is configured to engage a corresponding groove formation 18' of an adjacent panel. A lead-in chamfer 18" may be provided at the lowermost entry surface to the groove formation 18' to assist location of the adjacent plank and minimise the risk of damage. When lead-in chamfer 18" is included, a similar mate may be provided as depicted at 17".

A representative dimension for a panel as depicted in FIG. 5 includes an upper limit in width of the first recess of about 43 mm and an upper limit in width of the second recess of about 28 mm. In one example, a length of both tongue 17' and groove 18' is approximately 10 mm. It will be appreciated that this tongue and groove arrangement facilitates levelling of planks during installation and inhibits movement and reduces sound (e.g., rattling) of the planks when they are subjected to environmental changes, such as high winds. The facilitation is provided even when the tongue and groove formations are incompletely engaged.

Figure 6:
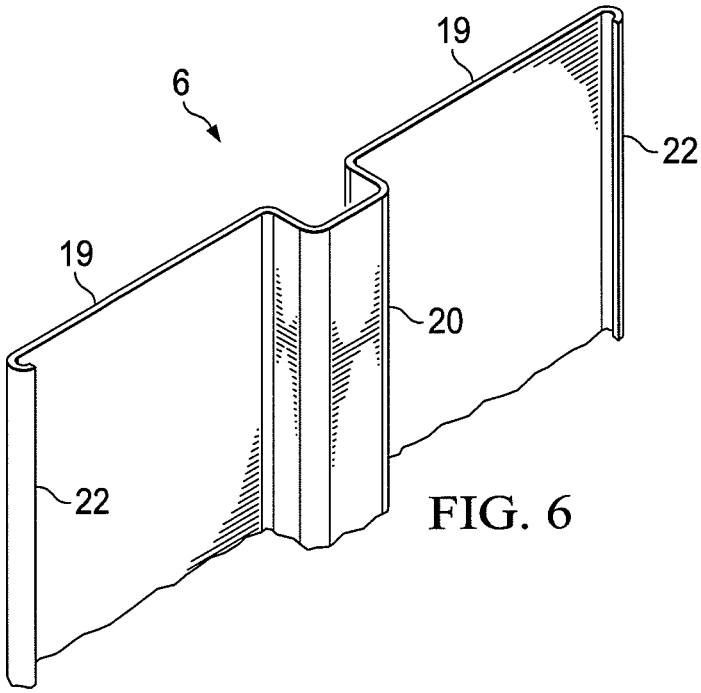
FIG. 6 is a perspective part view of a representative longitudinal end trim element as described herein.

Turning next to FIG. 6, there is shown, in perspective view, a joining strip 6 which is generally used to define a recessed joint intermediate two adjacent arrays. Strip 6 includes a base portion 19, which is adapted to be secured in a vertical orientation to a structural member such as a wall stud. In the centre of the joining strip there is a raised rib formation 20 which will typically have a raised height less than panel 2 (as shown in FIG. 1) so that, when installed, an upper surface of rib 20 provides an appearance of a recessed vertical masonry joint that corresponds closely with the depth of the recessed joint mimicked by the first recess 13 formed in each of the panels.

A joining strip of FIG. 6 may also include an optional lip formation 22 formed along one or both longitudinal edges. Formation 22 aids in the prevention of moisture that may enter a joint. Often moisture may migrate laterally into a cavity behind cladding.

A joining strip as described herein is preferably made of a thin sheet of metal or a durable plastic material. When assisted by formation 22, it is understood that formation 22 will be capable of deforming to some extent once the panels are installed. As such, a preferable material for a joining strip is one capable of some deformation.

Figure 7:
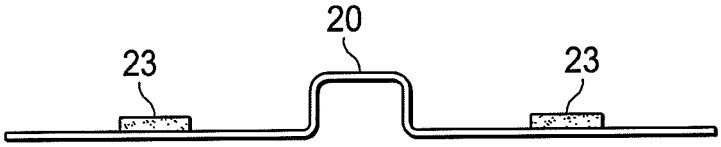
FIG. 7 is an end view of the trim element shown in FIG. 5 with optional components.

A joining strip may also be configured as is shown in FIG. 7. With this configuration, base panel 19 and rib formation 20 remain are constructed generally as described with FIG. 6. FIG. 7 also includes a self adhesive compressive sealing strip 23 generally as shown in the figure. The compressive sealing strip may also be glued on and provide an alternative sealing mechanism to that disclosed in FIG. 6 as formation 22. When desired, both sealing features, compressive sealing strip and formation 22, may be included in a single joining strip. In still further embodiments, conventional sealing compounds are applied to the joining strip as the panels are installed. All such sealing features may be used in any combination as desired.

FIGS. 10 to 13 show joining strips 6' and 6" that may be provided at a corner of a wall structure to enable one array of panels to be arranged transversely to another adjacent array of panels. Views of wall structures in which wall cladding as described herein have been installed are shown in FIGS. 14 to 17, each of which shows various and representative joining strips identified as 6*a* (FIG. 14), 6*b* (FIG. 15), 6*d* (FIG. 16) and 6*c* (FIG. 17).

Figure 11:
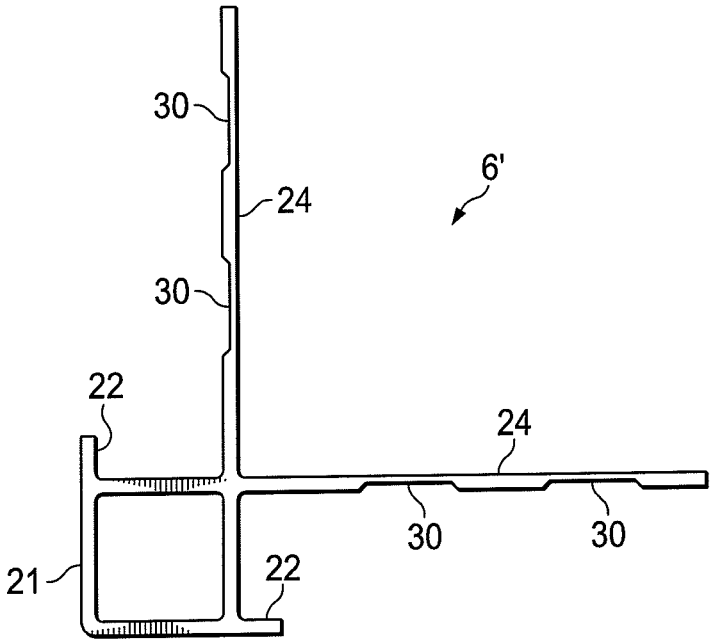
FIG. 11 is an end view of the external corner trim element of FIG. 10.
Figure 13:
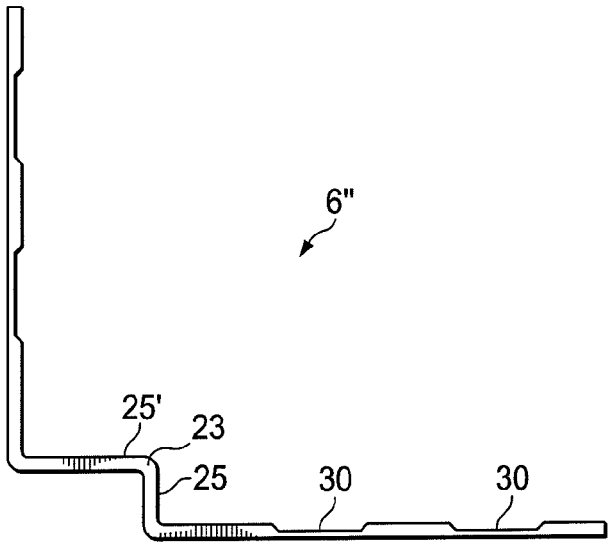
FIG. 13 is an end view of the internal corner trim element of FIG. 12.

In one or more embodiments, corner joining strips also include longitudinal indentations 30 on at least one surface that act as nailing guides and/or capillary breaks for water ingress, as depicted representatively in FIG. 11 and FIG. 13.

Figure 10:
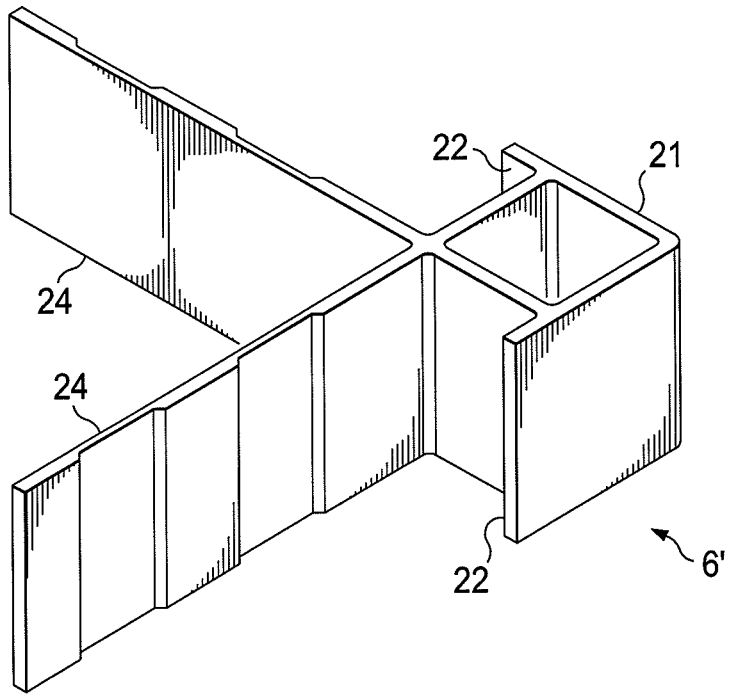
FIG. 10 is a perspective view of a representative external corner trim element as described herein.
Figure 15:
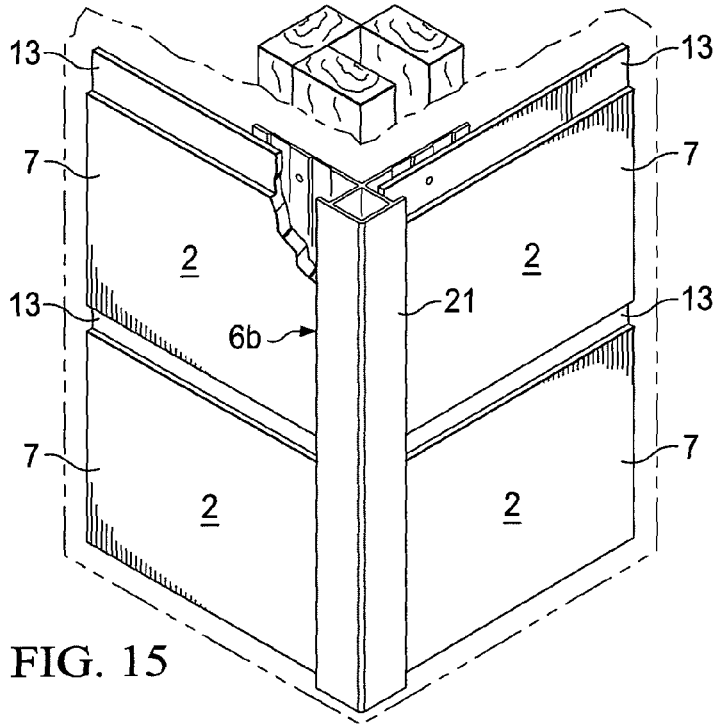
FIG. 15 is a partial view of a cladding system on an external corner of a wall structure and showing a portion of an external corner trim element similar to that disclosed in FIG. 10.

FIGS. 10 and 11 show various views of one representative trim element. The trim element generally includes an external corner joining strip 6' and having a substantially L- or V-shaped member 24 that may be mountable to a structural member such as a corner stud member of a wall structure or frame. The external corner joining strip has a corner formation, preferably in the form of a square tube 21, to provide the visual appearance of a box corner as shown in FIG. 15. As shown in FIG. 11, the external corner joining strip typically has flange projections 22 extending from the square tube 21 to cover ends of panels that are positioned adjacent the square tube.

Figure 12:
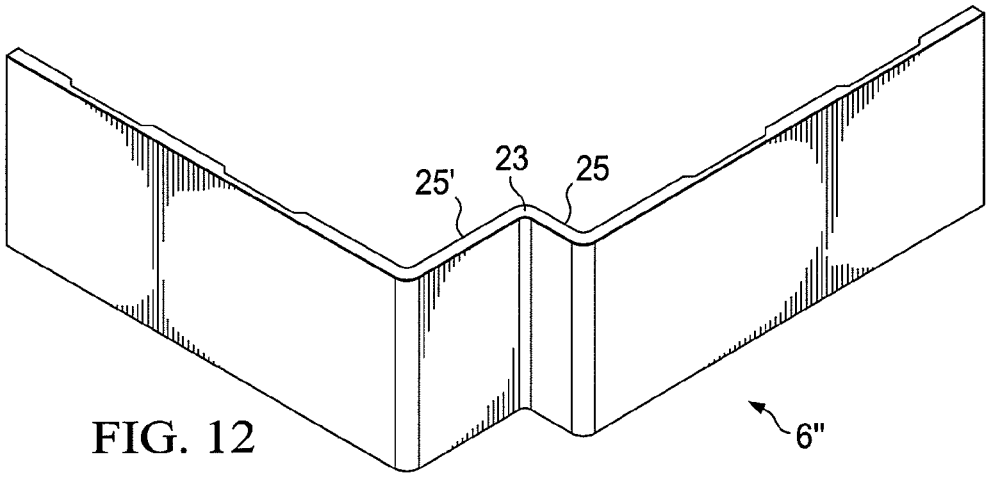
FIG. 12 is a perspective view of a representative internal corner trim element as described herein.

FIGS. 12 and 13 show another representative trim element in the form of an internal corner joining strip 6" which is substantially L- or V-shaped. The corner of the "L" is inwardly stepped to provide a corner formation 23 having two surfaces 25 and 25' against which the ends of panels of transversely arranged panels and/or arrays may be aligned. A representative figure of such an alignment is shown in FIG. 17.

Often, surface 25' is typically wider than surface 25, as illustrated in FIG. 12. A difference in width will enable abutting ends of transversely arranged panels to partially overlap, resulting in a clean and neat visual appearance at the corner. It will be appreciated that this is advantageous, as it is often difficult, if not impossible, to align corner edges of transversely arranged panels due to manufacturing tolerances in the panels and/or building creep.

Figure 14:
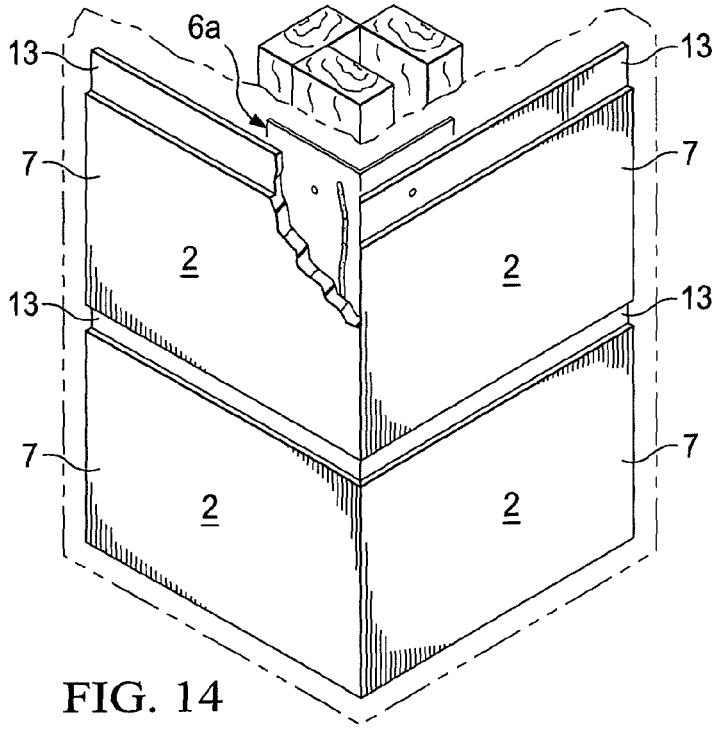
FIG. 14 is a partial view of a cladding system on an external corner of a wall structure having a mitered corner and showing a portion of an external corner trim element.

FIGS. 14 and 15 illustrate external corners and corner joining strips 6*a* and 6*b*. FIGS. 16 and 17 illustrate internal corners and internal corner joining strips 6*a* and 6*c*. Corner joining strips are generally provided in the form of an L-shaped or V-shaped member with an extended or non-extended corner formation. With these embodiments and when desired, ends of the panels may be mitered to form a mitered corner by transversely abutting panels.

Panels as described herein are made from any material having acceptable durability when exposed to the weather. In one form, the panels are fiber cement panels, shaped as desired and as described herein. Preferably the fiber cement is nailable. In many embodiments, a panel would have a length to width ratio greater than 4 and a length that corresponds to some multiple of conventional framing stud spacing for a desired regions in which the product is to be used. In Australia, one preferred length is about 4.2 m.

It will be appreciated that this cladding system is designed with simplicity in mind and to be applied to virtually any structural wall structure (e.g., frame). Particularly suitable wall structures are those made of timber or metal. In use with such wall structures, and referring to elements as described and shown with FIG. 1, a strip 6 is first secured to a vertical stud member that defines an edge for array 4. A first panel 2 is then positioned with its end 9 abutting a rib 20 and secured in a generally horizontal orientation to a series of adjacent vertical stud members 25. Where one of the overlapping panel embodiments are used, such as those shown in FIGS. 3 to 5), panel 2 should be oriented with a first major face facing outwards and a first recess uppermost.

A panel as described above is generally secured to the underlying structural wall structure by any suitable means, which will depend on the wall structure and panel materials. For example, when cladding panels are made from a nailable material and the studs are a nailable material (e.g., timber or nailable metal), conventional nails are typically suitable for fixing said panels. Nails that may be concealed, such as brad style nails, may be preferred when desired. Where the width of the recess 13 allows, fixing is preferably along that recess adjacent the outermost edge. This step, while not essential, ensures that the fixing will be concealed when the next panel is positioned on top. The spacing of the fixings along the length of the panel will generally be determined by stud spacing. Such spacing may vary and is typically that recommended by the desired manufacturer and/or by relevant building codes.

A second panel is positioned on top of the first and underlying panel, again with ends 9 aligning with rib 20 on strip 6, as illustrated in FIG. 1. The prior step is repeated until an array has been completed. Multiple arrays are prepared as described for the single array.

In a representative example, a wall cladding is formed by first providing a wall structure or by constructing a frame. Often the frame is fully loaded and will include a suitable stud arrangement, such as double 45 mm studs, double 35 mm studs separated by 15 mm packers and/or triple 35 mm stud, at all vertical joints. When desired, a vapor permeable membrane may be installed with a suitable overhang. Set up datum line; the datum will typically be the bottom edge of the first panel; the datum line should be square to vertical flashing stops and square to the bottom edge of the first panel. A sealant may be applied inside fastener locations. A first board is positioned to provide a suitable overhang, which is often 20-50 mm. Fixing of the first board to a bottom plate may be performed. Panels should be suitably arranged so at to be appear locked in firmly. A second panel is then fixed and before fitting a third panel until all remaining panels are fixed. Preferably, each panel is made level and the height of each row of panel is kept the same. When desired, a joint sealant may also be applied to each panel at the joint just prior to installation of each panel.

When desired, panels may be joined on and off stud without the use of a vertical flashing stop to create a traditional butt join. In some embodiments and to maximize strength and aesthetic features, butt joins may be staggered over two or more stud lines (e.g., do not locate joints in the same vertical line).

At vertical joints, vertical flashing stops may be used and fixed to studs. The rear of each panel may then be adhered to a vertical flashing strip using a suitable joint sealant, when desired.

Figure 8:
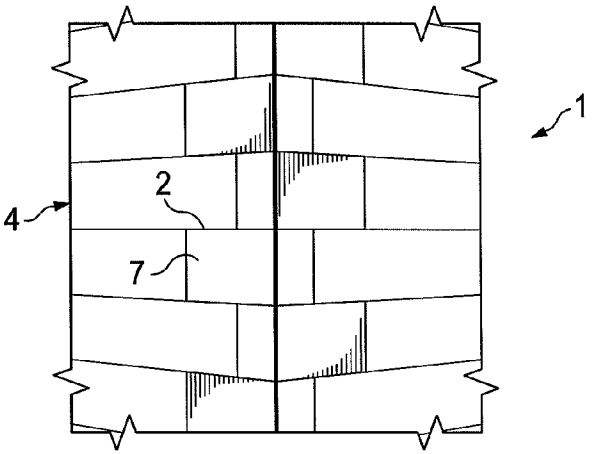
FIG. 8 is a representative schematic perspective view of a corner of a cladding system described herein when applied to a building.

FIG. 8 illustrate a representative design for a wall cladding as described herein showing panels 2 and outer face 7, a plurality of which are arranged in an array 4. Where the wall is designed to include one or more openings, such as windows or doors, panels 2 are readily cut to fit, as required.

Those skilled in the art will appreciate that the cladding system described herein may be used to achieve any aesthetic effects desired. For example, each panel shown in FIG. 8 are prepared to include a corner detail at its corner end to achieve a faux stone block effect that will replicate the appearance of a corner of a colonial style sandstone building. In one or more embodiments, one or more corner details of a cladding system described herein is provided in two-dimensional form by colouration of the end of the panel. In other embodiments, the corner detail is achieved in a three-dimensional form by a decorative arrangement, such as quoining, which may include fixing a further portion of cladding to the end of the panel. The further portion of cladding may be detailed by colouration or with some other visual or decorative detail, such as an engraving or pattern. The ends of the further portion of cladding may be mitered to provide a visual appearance at the corner as shown in FIG. 8.

Figure 9:
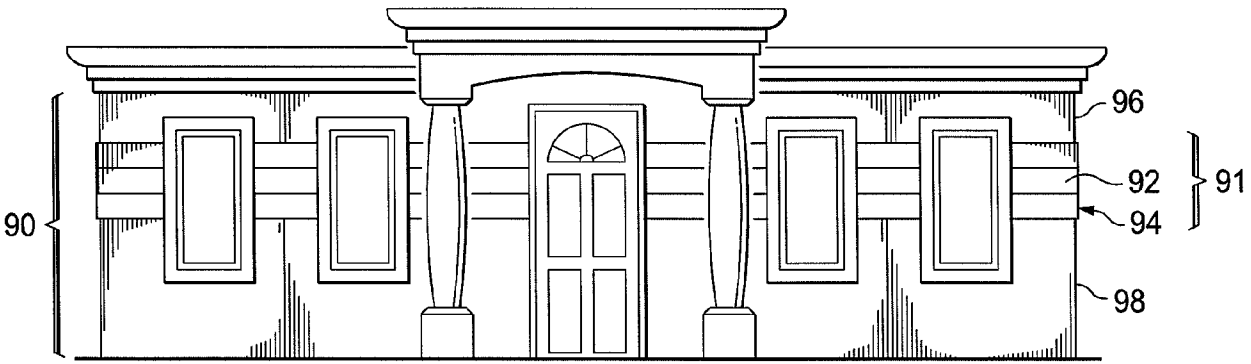
FIG. 9 is a representative schematic front view of a building having composite walls that include sections formed of a cladding system as described herein.

Referring now to FIG. 9, a further aesthetic effect is illustrated. The effect is achieved using a cladding system described herein as part of a composite wall system 90 in which upper section 96 and lower section 98 of composite wall 91 are formed of a conventional rendered panel construction and a middle section of the wall is formed with a cladding system 91 as described herein that includes a plurality of panels 92 formed in an array 94. External walls constructed a cladding described herein may include additional features, such as decorative arrangements, coloration, and/or patterning. The cladding system is fully compatible with insulation materials.

It will be appreciated that a masonry replica cladding system as described herein may be used to form only a part of a complete cladding system. For example, a complete cladding system may include several panels that have been cut to fit around a door or window such that ends of these panels do not align with the ends of other panels. A complete cladding system may further include masonry.

It will also be appreciated that while the preferred embodiment described is mounted directly to a frame structure, the system can also be used on housing structures which already include some form of board or cladding fixed onto the building frame. For example, the system may be installed over battens or directly onto a masonry wall.

As described is a cladding system comprising a plurality of panels. In one form, the plurality of panels is substantially rectangular in shape and/or substantially flat. In one or more embodiments, each panel will have a first and second major opposing faces, a first and second major opposing edges and a pair of opposing ends. Each panel typically further includes a first recess in its first major face adjacent the first major edge configured to resemble a recessed mortar joint. When used to form at least a portion of a wall cladding, the first major edge of a first panel is typically positioned adjacent the second major edge of an adjacent second panel, and the opposing ends of each panel are substantially aligned with corresponding opposing ends of adjacent panels which form respective side edges of an array of panels. When desired and/or suitable, each panel is elongate.

In one form, the recess formed in the first major face adjacent the first major edge has a width in excess of the intended width of the mimicked recess mortar joint, and each panel also includes at least one second recess in its second major face adjacent the second major edge wherein, when used to form a wall cladding, the second major edge of a first panel is configured to at least partially overlap the first major edge of a second panel. In this manner, each installed panel may be retained by the overlapping edge of an adjacent panel.

The recess in the first major face of each panel adjacent the corresponding first major edge is of sufficient width to facilitate fixing of the panel on an inner portion of the first recess such that in use the fixing will be concealed by an overlapping second major edge of an adjacent panel.

The first recess in the first major face of each panel may further include a retaining formation adapted to inter-engage a corresponding retaining formation on an innermost edge of the second recess formed on the second major face, which in use operates to locate and retain each panel in engaging alignment with an adjacent panel. Inter-engaging portions may be in the form of corresponding wedge formations or other mated extensions.

Each end of each panel preferably includes as a substantially planar abutment surface at all or a portion the surface. The planar abutment surface may be a squared end of the associated panel or may be a mitered end of the associated panel. In use, planar abutment surfaces of ends of each panel in the array of panels are substantially aligned to form an edge abutment surface of the array. Preferably, the edge abutment surface is substantially planar.

The cladding system may also include one or more trim elements for providing a weather-proof joint for at least one side edge of each array formed by the adjacent panel ends. In one form, the trim element comprises a thin strip of material (sometimes in the form of a sheet) having a central portion that extends between the aligned ends of two arrays of adjacent panels. The trim element may be designed to replicate a base of a recess that corresponds closely to the depth of the first recess formed in the first major face of each panel.

The trim element may also be provided at one or more corners as a corner trim element and facilitate a transverse arrangement of two arrays of panels. A corner trim element may be an internal corner trim element and/or an external corner trim element. The corner trim element may be a substantially L-shaped or V-shaped member and made capable of mounting to a structural member. A corner formation of the trim element may be arranged in one of a number of arrangements. In one form, the corner trim element may allow side edges of a first array of panels and side edges of a second array of panels to form a mitered corner when said panels abut. In addition, panels of transversely arranged arrays may be butt jointed. A trim element may be further arranged to reside between two sets of transverse panels (or arrays) such that each panel (or array) forms a butt joint against the trim element, rather than against each other.

A corner trim element may also include a corner formation against which the side edge of a first array of panels and a side edge of a second transverse array of panels can be aligned such the two arrays are arranged transversely to each other. The corner formation may be configured to provide a desired aesthetic effect for the corner. In some embodiments, a corner formation may be a square tube for providing a box corner.

A trim element may be elongate. The trim element may act as a corrosion resistant flashing. A suitable material for a trim element is aluminium. However, other materials, as described previously are similarly suitable.

Panels as described herein are generally secured to the wall structure in a generally horizontal configuration. It will be appreciated, however, that the panels may be oriented vertically or obliquely on wall sections, and indeed may also be used on ceilings, in any desired configuration, including flat or raked.

A wall structure as described herein is generally a walling frame being of a nailable form and a plurality of panels described herein are secured directly to the wall structure or frame. In other forms, the a wall structure may include a frame structure or lightweight concrete structure or existing wall of any building structure, to which a panelized or strip substrate is applied, to which the panels are secured.

A wall cladding as described herein may be used as required to clad both internal and external walls. In one or more embodiments, the wall cladding resembles and/or replicates masonry. In other embodiment, the wall cladding includes masonry.

A method of forming a wall cladding generally comprises erecting a sub-structure, securing to the sub-structure a plurality of panels, each panel having first and second major opposing faces, first and second major opposing edges and a pair of opposing ends. Each panel typically also includes a first recess in its first major face adjacent the first major edge configured in use to resemble a recessed mortar joint wherein, when used to form at least a portion of a wall cladding, the first major edge of a first panel is positioned adjacent the second major edge of an adjacent second panel, and the opposing ends of each panel are substantially aligned with the corresponding opposing ends of adjacent panels to form respective side edges of an array of panels.

A method of forming a wall cladding system typically includes erecting a sub-structure, securing to the sub-structure a plurality of panels, and joining two array of panels with a joining element, wherein the element is positioned in contact with each of the arrays, wherein the contact resembles a joint with at least one side edge of each array. Each panel typically has first and second major opposing faces, first and second major opposing edges and a pair of opposing ends. Each panel also generally has a first recess in its first major face adjacent the first major edge configured in use to resemble a recessed mortar joint wherein, when used to form at least a portion of a wall cladding, the first major edge of a first panel is positioned adjacent the second major edge of an adjacent second panel, and the opposing ends of each panel are substantially aligned with the corresponding opposing ends of adjacent panels to form respective side edges of an array of panels.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

While specific as well as alternatives to systems and steps of the invention have been described herein, additional alternatives not specifically disclosed but known in the art are intended to fall within the scope of the invention. Thus, it is understood that other applications of the present invention will be apparent to those skilled in the art upon reading the described embodiment and after consideration of the appended claims and drawing.

What is claimed:

1. A wall cladding comprising:

a first array of panels and a second array of panels, wherein the first array of panels is positioned in a horizontal abutting relationship with the second array of panels;

each panel having:

first and second major opposing faces;

first and second major opposing edges; and a pair of opposing ends;

each panel further having a first recess in its first major face adjacent the first major edge, said first recess defined by an interior horizontal surface extending horizontally from the first major face to a first depth in the panel and an interior vertical surface extending orthogonally from the interior horizontal surface to the first major edge;

a first retaining formation formed on the first major edge;

a second recess in its second major face adjacent to the second major edge, said second recess extending inwardly from the second major edge; and a second retaining formation formed on the innermost edge of the second recess formed along the second major edge thereby configured to form a recessed joint area resembling a recessed mortar joint between a first panel and a second panel in each array when the first retaining formation of the first panel inter-engages with the second retaining formation of the second panel, said recessed joint area having two spaced apart horizontal sidewalls and a vertical sidewall extending therebetween, said horizontal sidewalls are defined by the interior horizontal surface of the first panel and the second major edge of the second panel, said vertical sidewall defined by an exposed portion of the interior vertical surface of the first panel, and wherein the first recess serves to locate and retain the first panel in engaging alignment with the second panel such that the opposing ends of each panel are substantially aligned with the corresponding opposing ends of adjacent panels to form respective side edges of the first and second arrays of panels; and a vertical joining element configured to define a recessed joint intermediate the first array and the second array of panels, said vertical joining element comprising an elongate base and a raised rib formation that extends along a longitudinal axis of the base thereby dividing the base into two elongate portions, wherein each elongate portion is configured to contact the respective side edges of panels in the first and second arrays, wherein the raised rib formation has a height that is less than the thickness of the panels such that an upper surface of the raised rib formation provides an appearance of a recessed vertical masonry joint that corresponds with the depth of the recessed joint area between panels within the same array.

2. The wall cladding of claim 1 wherein the interior vertical surface formed in the first major face adjacent the first major edge has a width in excess of the width of the horizontal sidewall of the recessed joint area.

3. The wall cladding of claim 1 wherein the recess in the first major face of each panel adjacent the corresponding first major edge is of sufficient width to facilitate fixing of the panel on an inner portion of the first recess such that in use the fixing will be concealed by the overlapping second major edge of an adjacent panel.

4. The wall cladding of claim 1 wherein the first recess includes a wedge configuration formed by profiling the second major face adjacent the first major edge.

5. The wall cladding of claim 1 further including at least one longitudinal end trim element for providing a weatherproof joint for at least one side edge of each rectangular array formed by the adjacent panel ends.

6. The wall cladding of claim 1, wherein each end of each panel defines a planar abutment surface.

7. The wall cladding of claim 1, wherein each end of each panel is shaped from one selected from the group consisting of squared and mitered to define a planar abutment surface.

8. The wall cladding of claim 1, wherein the vertical joining element further comprises an adhesive element formed on the base, said adhesive element secures the side edges of the panels to the joining element.

9. The wall cladding of claim 1, wherein each panel has a major face length to width ratio greater than 4.

10. The wall cladding of claim 1, wherein the vertical joining element further comprises a lip formation disposed along at least one longitudinal edge of the base, said lip formation inhibits moisture migration.

11. A wall cladding system comprising:

a sub-structure;

a plurality of panels secured to the wall sub-structure, each panel having:

first and second major opposing faces;

first and second major opposing edges;

and a pair of opposing ends;

each panel further having a first recess in its first major face adjacent the first major edge;

a first retaining formation formed on the first major edge;

a second recess in its second major face adjacent to the second major edge; and a second retaining formation formed on the innermost edge of the second recess formed along the second major edge thereby configured to resemble a recessed mortar joint when used to form at least a portion of a wall cladding, the first retaining formation of a first panel is positioned adjacent the second retaining formation of an adjacent second panel, and the opposing ends of each panel are substantially aligned with the corresponding opposing ends of adjacent panels to form respective side edges of an array of panels, a corner joining element, said corner joining element comprising at least two elongate base members positioned at an angle relative to each other so as to form a corner portion, wherein the corner portion is inwardly stepped so as to provide a corner formation having two surfaces against which the ends of panels of transversely arranged panels may be aligned.

12. The wall cladding system of claim 11, wherein each panel is elongate.

13. The wall cladding system of claim 11, wherein each panel is secured to the wall sub-structure.

14. The wall cladding system of claim 11, wherein the panels are arranged in a configuration selected from the group consisting of horizontal, vertical and oblique.

15. A method of forming a wall cladding, the method comprising the steps of:

erecting a sub-structure;

securing to the sub-structure a vertical joining element, said vertical joining element having an elongate base and a raised rib formation;

securing to the sub-structure a plurality of panels, each panel having:

first and second major opposing faces;

first and second major opposing edges; and a pair of opposing ends;

each panel further having a first recess in its first major face adjacent the first major edge;

a first retaining formation formed on the first major edge;

a second recess in its second major face adjacent to the second major edge; and a second retaining formation formed on the innermost edge of the second recess formed along the second major edge;

aligning the panels in a manners such that the first retaining formation of a first panel is positioned adjacent the second retaining formation of an adjacent second panel wherein the first recess of each panel serves to locate and retain the panel in engaging alignment with the second recess of an adjacent panel such that a recessed joint defined by two spaced apart horizontal parallel sidewalls resembling a mortar joint is formed by the major opposing edges of the panels, and the opposing ends of each panel are substantially aligned with the corresponding opposing ends of adjacent panels to form respective side edges of an array of panels, and joining side edges of a first array of panels and side edges of a second array of panels and forming a butt joint against the joining element wherein the side edges of each panel abut the raised rib formation of the vertical joining element, wherein the height of the raised rib formation is less than the thickness of the panel such that an upper surface of the raised rib formation provides an appearance of a recessed vertical masonry joint.

16. The method of claim 15, wherein each panel is elongate.

17. The method of claim 15, wherein securing is in a configuration selected from the group consisting of horizontal, vertical and oblique.

18. The method of claim 15 further comprising joining side edges of a first array of panels and side edges of a second array of panels and forming a mitered corner when said panels abut.

19. The method of claim 15 further comprising joining side edges of a first array of panels and side edges of a second array of panels and forming a butt joint against a joining element positioned between the first and second array of panels.

20. A wall cladding system comprising:

a sub-structure;

a plurality of panels secured to the wall sub-structure, each panel having:

first and second major opposing faces;

first and second major opposing edges; and a pair of opposing ends, each panel further having a first recess in its first major face adjacent the first major edge;

a first retaining formation formed on the first major edge;

a second recess in its second major face adjacent to the second major edge; and a second retaining formation formed on the innermost edge of the second recess formed along the second major edge thereby configured to formed a recessed joint area, when used to form at least a portion of a wall cladding, said recessed joint area defined by two spaced apart horizontal walls interconnected by a vertical wall, the first retaining formation of a first panel is positioned adjacent the second retaining formation of an adjacent second panel, and the opposing ends of each panel are substantially aligned with the corresponding opposing ends of adjacent panels to form respective side edges of an array of panels;

and a joining element, wherein the element is positioned vertically in contact with two adjacent arrays, wherein the contact resembles a joint with at least one side edge of each array, wherein the joining element comprises a tubular structure and flange projections extending from the tubular structure to cover panels positioned adjacent the tube.

21. The wall cladding system of claim 20, wherein a central portion of the joining element extends between aligned ends of two arrays of adjacent panels.

22. The wall cladding system of claim 20, wherein the joining element is aligned to replicate a base of a recess that corresponds closely to the depth of the first recess formed in the first major face of each panel.

23. The wall cladding system of claim 20, wherein the joining element forms a corner.

24. The wall cladding system of claim 20, wherein the joining element provided at a corner facilitate a transverse arrangement of two arrays of panels.

25. The wall cladding system of claim 20, wherein the joining element is an external corner trim.

26. The wall cladding system of claim 20, wherein the joining element is an internal corner trim.

27. The wall cladding system of claim 20, wherein the joining element is mounted to a structural member.

28. The wall cladding system of claim 20, wherein the joining element allows side edges of a first array of panels and side edges of a second array of panels to form a mitered corner when said panels abut.

29. The wall cladding system of claim 20, wherein the joining element allows side edges of a first array of panels and side edges of a second array of panels to form a butt joint.

30. The wall cladding system of claim 20, wherein the joining element allows side edges of a first array of panels and side edges of a second array of panels to form a butt joint against the joining element.

31. The wall cladding system of claim 20, wherein the joining element includes square configuration for providing a box corner.

32. The wall cladding system of claim 18, wherein the joining element is in behavior a corrosion resistant flashing.

33. The wall cladding system of claim 18, wherein the joining element is aluminium.

34. A method of forming a wall cladding system, the method comprising the steps of:

erecting a sub-structure;

securing to the sub-structure a plurality of panels, each panel having:

first and second major opposing faces;

first and second major opposing edges; and a pair of opposing ends;

each panel further having a first recess in its first major face adjacent the first major edge;

a first retaining formation formed on the first major edge;

a second recess in its second major face adjacent to the second major edge; and a second retaining formation formed on the innermost edge of the second recess formed along the second major edge wherein the first retaining formation of a first panel is positioned adjacent the second retaining formation of an adjacent second panel in a manners such that at least a portion of the first recess is exposed to resemble a recessed mortar joint, and the opposing ends of each panel are substantially aligned with the corresponding opposing ends of adjacent panels to form respective side edges of an array of panels; and joining two array of panels with a joining element, wherein the element is positioned vertically in contact with each of the arrays, wherein the contact resembles a joint with at least one side edge of each array, wherein the element comprises a raised rib, wherein the height of the raised rib is less than the thickness of each panel.

35. The method of claim 34, wherein each panel is elongate.

36. The method of claim 34, wherein securing is in a configuration selected from the group consisting of horizontal, vertical and oblique.

37. The method of claim 34, wherein joining includes positioning a central portion of the joining element between aligned ends of two arrays of adjacent panels.

38. The method of claim 34, wherein joining includes positioning two arrays to form a corner.

39. The method of claim 34, wherein joining includes providing the joining element as an external corner trim.

40. The method of claim 34, wherein joining includes providing the joining element as an internal corner trim.

41. The method of claim 34 further comprising mounting the joining element to the sub-structure.

42. The method of claim 34, wherein joining includes having side edges of a first array of panels and side edges of a second array of panels forming a mitered corner when said panels abut.

43. The method of claim 34, wherein joining includes having side edges of a first array of panels and side edges of a second array of panels forming a butt joint.

44. The method of claim 34, wherein joining includes having side edges of a first array of panels and side edges of a second array of panels forming a butt joint against the joining element.

* * * * *